US009173790B2

(12) United States Patent
Schwar et al.

(10) Patent No.: US 9,173,790 B2
(45) Date of Patent: Nov. 3, 2015

(54) STORAGE ARRANGEMENT FOR MEDICALLY-RELATED TRANSPORT OR EVACUATION DEVICE(S)

(71) Applicant: MEMORIAL SLOAN-KETTERING CANCER CENTER, New York, NY (US)

(72) Inventors: Robert Schwar, Forestburgh, NY (US); Gregory Ayzenberg, Brooklyn, NY (US); Robert Zdenek, Lindenhurst, NY (US); Linda Reissman, Stony Point, NY (US); Vadesh Rampersad, Fairview, NJ (US); Jacob Neufeld, Brooklyn, NY (US)

(73) Assignee: Memorial Sloan-Kettering Cancer Center, New York, NY (US)

( * ) Notice: Subject to any disclaimer, the term of this patent is extended or adjusted under 35 U.S.C. 154(b) by 0 days.

(21) Appl. No.: 14/093,258

(22) Filed: Nov. 29, 2013

(65) Prior Publication Data

US 2014/0145568 A1 May 29, 2014

Related U.S. Application Data

(60) Provisional application No. 61/730,644, filed on Nov. 28, 2012, provisional application No. 61/839,949, filed on Jun. 27, 2013.

(51) Int. Cl.

| | |
|---|---|
| ***A61G 1/01*** | (2006.01) |
| ***A47B 95/00*** | (2006.01) |
| ***A47B 67/00*** | (2006.01) |

(52) U.S. Cl.

CPC . *A61G 1/01* (2013.01); *A47B 67/00* (2013.01); *A47B 95/008* (2013.01)

(58) Field of Classification Search

CPC ..... F24F 13/20; H02B 1/38; H02B 1/44; A47B 95/008

USPC ..... 312/100–102, 245, 323, 326–329

See application file for complete search history.

(56) References Cited

U.S. PATENT DOCUMENTS

| | | | | | |
|---|---|---|---|---|---|
| 1,685,462 | A | * | 9/1928 | Palmer | 361/659 |
| 3,027,215 | A | * | 3/1962 | Duncan | 312/245 |
| 3,241,901 | A | * | 3/1966 | Waybright | 312/201 |
| 3,479,104 | A | * | 11/1969 | Kobryner | 312/229 |
| 4,325,594 | A | * | 4/1982 | Lang et al. | 312/100 |
| 5,388,570 | A | * | 2/1995 | Wassil | 312/245 |
| 5,476,316 | A | * | 12/1995 | Batroney et al. | 312/287 |
| 5,706,986 | A | * | 1/1998 | Brandenburg et al. | 222/192 |
| 5,751,543 | A | * | 5/1998 | Gehrs et al. | 361/641 |
| 5,901,868 | A | * | 5/1999 | Fahey et al. | 220/4.02 |

(Continued)

*Primary Examiner* — Hanh V Tran

(74) *Attorney, Agent, or Firm* — Andrews Kurth LLP

(57) ABSTRACT

An exemplary storage arrangement can be provided, which can include a first section and a second section. The first section can be moveable between a first configuration and a second configuration and can have at least one slot. The second section can be coupled to the first section and comprising at least one protrusion configured and dimensioned to mate with the slot(s) to facilitate movement of the first section. In the exemplary storage arrangement, the space formed by the first and second sections can receive a portable transportation arrangement, and at least one of the first section or the second section can be coupled to a configuration provided at or near a patient. Alternatively or in addition, the exemplary storage arrangement can include a locking mechanism which can be configured to secure at least one portion of the first section to the second section.

16 Claims, 15 Drawing Sheets

(56) References Cited

U.S. PATENT DOCUMENTS

| | | | | |
|---|---|---|---|---|
| 5,924,781 | A * | 7/1999 | Mitchell | 312/245 |
| 6,338,535 | B1 * | 1/2002 | Rickert | 312/311 |
| 6,382,743 | B1 * | 5/2002 | Gollob | 312/102 |
| 6,641,237 | B1 * | 11/2003 | Pryor et al. | 312/245 |
| 2010/0219728 | A1 * | 9/2010 | Wolpow | 312/326 |

* cited by examiner

STORAGE ARRANGEMENT FOR MEDICALLY-RELATED TRANSPORT OR EVACUATION DEVICE(S)

CROSS-REFERENCE TO RELATED APPLICATION(S)

The present disclosure relates to and claims priority from U.S. patent application Ser. No. 61/730,644, filed Nov. 28, 2012, and U.S. patent application Ser. No. 61/839,949, filed Jun. 27, 2013, the entire disclosures of which are incorporated herein by reference.

FIELD OF THE DISCLOSURE

The present disclosure relates generally to storage arrangements) for medically-related transport or evacuation device(s). More specifically, according to exemplary embodiments of the present disclosure, the storage arrangement(s) can be provided to hold transport and/or evacuation sheet stretchers that can be stored and/or placed in close proximity to a patient.

BACKGROUND INFORMATION

Accelerated or emergency preparedness in the hospital setting is necessary, particularly in the event of an unscheduled transport or an evacuation. One important aspect of such preparedness is having appropriate evacuation equipment readily available especially if the staff has to evacuate non-ambulatory patients from the hospital.

Portable transportation units, such as evacuation sheet stretchers, can be important when it comes to evacuating patients, particularly non-ambulatory patients, from the hospital. Evacuation sheet stretchers facilitate a quick and safe evacuation or transport because they can increase patient safety and prevent a patient from injuring themselves or staff during transportation.

Because of the importance of evacuation sheet stretchers, they should be kept in close proximity to the patient for easy access. Storage, however, is limited in hospitals and the evacuation sheet stretcher cannot be kept in a location that is not easily accessible during time of emergency. For example, if the evacuation sheet stretcher is maintained in a storage closet or basement, staff members would have to go to the storage closet or basement, find the evacuation sheet, and retrieve it. This could be problematic because it would create a delay in providing the emergency equipment to the patient, and retrieving the equipment can be dangerous to the staff if the storage closet is near the source of danger, i.e. a fire.

Preferably, the evacuation sheet stretcher should not be placed under hospital mattresses because it could cause a shift in pressure, which can lead to patient bed sores. Additionally, on certain types of bed, the evacuation sheet could potentially cause an interference with electronic devices which can be connected to the hospital bed. Another problem with storing the evacuation sheet stretcher under the hospital bed or mattress is that the evacuation sheets would be unprotected, and thus, could potentially become soiled, and/or lost during bed repairs. Because the sheet stretcher may not be clearly visible under the hospital mattresses, it would be difficult to determine whether the sheet stretcher is cleaned, soiled, or even present.

There are several devices available for sheet stretchers. However, one limitation of these devices is they are not necessarily provided in a fixed or set location in the hospital room or in near proximity to the patient. Another limitation of these devices is that they do not account for patient's being moved or transported to other locations during an evacuation. For example, if a patient is being transported by gurney or other similar transportation device, the sheet stretcher may not be moved along with the patient (i.e., if the sheet stretcher is stored in a closet), and thus, is not readily available in case of an emergency during transport. Further, the devices presently used with the sheet stretchers do not account for whether the sheet stretcher has been compromised due to unauthorized handling or use, which would make the sheet stretcher unfit for use during an actual emergency.

Thus, there may be a need for a storage arrangement that is readily accessible, secure, visible, and sanitary while also not interfering or impeding the work-flow of hospital operations and staff, and which can overcome at least some of the deficiencies described herein above.

SUMMARY OF EXEMPLARY EMBODIMENTS

These and other objects of the exemplary embodiments of the present disclosure can be achieved by an exemplary storage arrangement, which can include a first section and second section.

According to one exemplary embodiment of the present disclosure, an exemplary storage arrangement can be provided, which can include a first section and a second section. The first section can be moveable between a first configuration and a second configuration and can have at least one slot. The second section can be coupled to the first section and comprising at least one protrusion configured and dimensioned to mate with the slot(s) to facilitate movement of the first section. In the exemplary storage arrangement, the space formed by the first and second sections can receive a portable transportation arrangement, and at least one of the first section or the second section can be coupled to a configuration provided at or near a patient.

The first section can include at least one side portion, and the at least one slot can extend vertically along the side portion(s). The second section can comprise of at least one side panel, and the protrusion(s) can extend from the side panel(s). The slot(s) can be mated with the protrusion(s), and the first section can be pivotable about the protrusion(s) to facilitate a movement of the first section with respect to the second section.

The exemplary storage arrangement can comprise a locking mechanism that can be configured to secure at least one portion of the first section to the second section. The locking mechanism can include a removable pin and pin holes. The pin holes can be on at least one of the first section or second section, and can be configured to receive the pin when the first section is in the first configuration. In some exemplary configurations, the exemplary storage arrangement can further comprise an indicator that can indicate whether the storage arrangement had been previously opened.

The exemplary storage arrangement can also include a securing bracket that can be affixed to the second section, and can be configured to secure the storage arrangement to a wall. In some further exemplary embodiments of the present disclosure, the exemplary storage arrangement can further comprise a securing bracket that can be affixed to the second section, and can be configured to secure the storage arrangement to a bed.

According to yet another exemplary embodiment of the present disclosure, an exemplary storage arrangement can be provided, which can include a first section and second section. The first section can be moveable between a first configuration and a second configuration. The second section can be coupled to the first section and facilitate movement of the first section. The exemplary storage arrangement can further include a locking mechanism that can be configured to secure at least one portion of the first section to the second section. In the exemplary storage arrangement, the space formed by the first and second sections can receive a portable transportation arrangement, and the at least one of the first section or the second section can be coupled to a configuration provided at or near a patient.

In one exemplary embodiment of the present disclosure, the first section of the exemplary storage arrangement can also include a top panel that is affixed to and disposed generally perpendicular to the at least one portion of the first section. In other exemplary embodiment of the present disclosure, the locking mechanism can include a removable pin and pin holes on at least one of the first section or the second section configured to receive the pin when the first section is in the closed configuration.

In yet other exemplary configurations of the exemplary storage arrangement, the exemplary storage arrangement can also include an indicator that can indicate whether the storage arrangement had been previously opened.

In other exemplary configurations, the exemplary storage arrangement can include a third section affixed to the first and second sections. In certain exemplary embodiments of the present disclosure, the exemplary storage arrangement can include a fourth panel affixed to the second section, and disposed opposite and parallel to the first section.

The exemplary storage arrangement can also include a securing bracket affixed to the second section, and configured to secure the storage arrangement to a wall or in other configurations, a bed.

According to a further exemplary embodiment of the present disclosure, a method can be provided for providing a storage arrangement that is that can be situated near a patient. For example, a storage arrangement is configured to receive and/or store a portable transportation arrangement, and can comprise a first section of the storage arrangement which can be moved with respect to a second section of the storage arrangement in an upward and/or outward direction. The first section can have at least one slot configured to mate with at least one protrusion coupled to the second section to facilitate the movement of the first section with respect to the second section. In an exemplary operation, the first section can pivot about the protrusion(s) in a second direction which is different from the first. Indeed, an open area can be formed or availed within the second section to receive or remove the portable transportation arrangement.

These and other objects, features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Further objects, features and advantages of the present disclosure will become apparent from the following detailed description taken in conjunction with the accompanying Figures showing illustrative embodiments of the present disclosure, in which.

Figure 1:
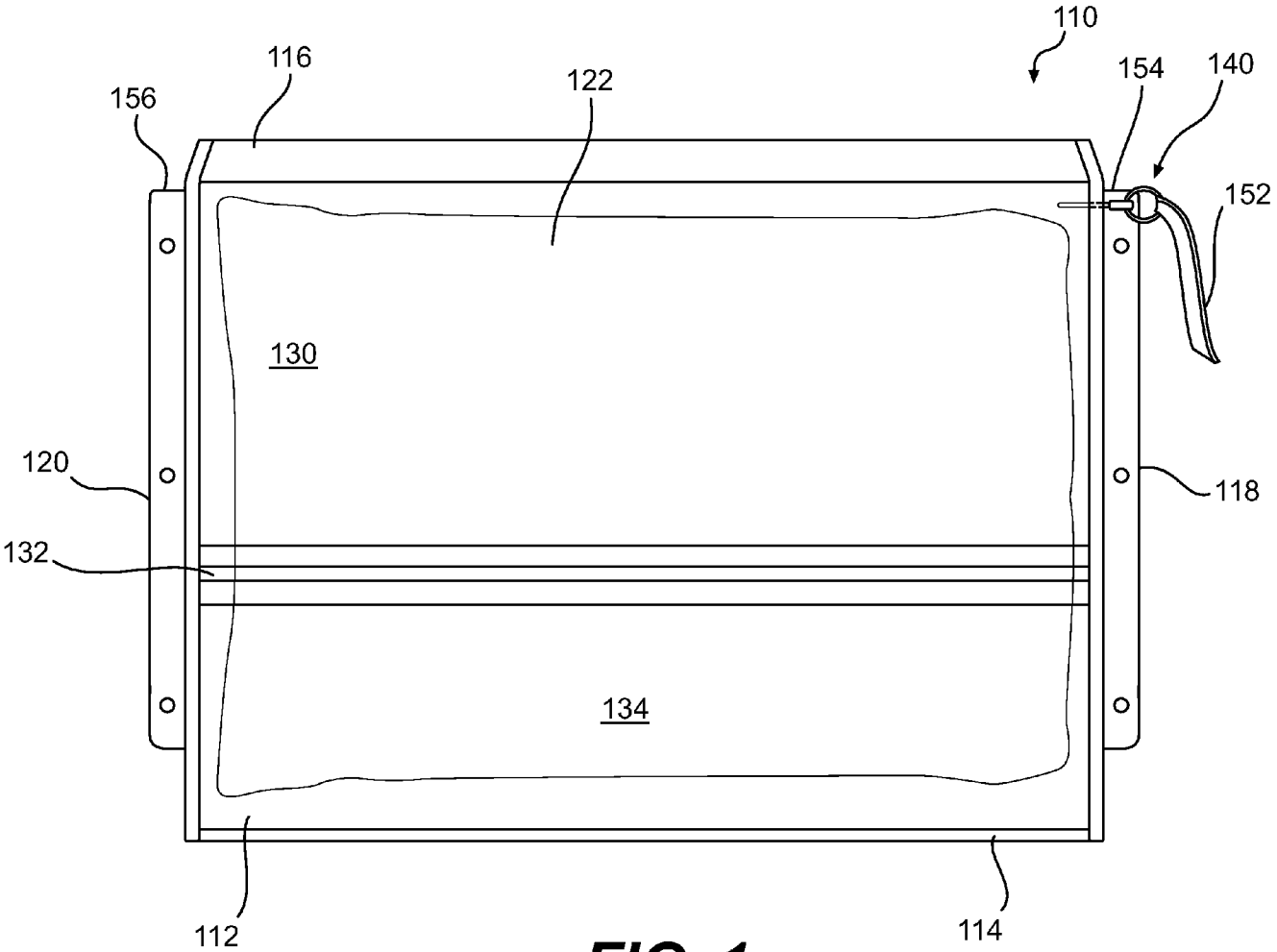
FIG. 1 is an illustration of an exemplary storage arrangement with an article inserted in the storage arrangement according to an exemplary embodiment of the present disclosure.

Throughout the drawings, the same reference numerals and characters, unless otherwise stated, are used to denote like features, elements, components, or portions of the illustrated embodiments. Moreover, while the present disclosure will now be described in detail with reference to the figures, it is done so in connection with the illustrative embodiments and is not limited by the particular embodiments illustrated in the figures or the appended claims.

DETAILED DESCRIPTION OF EXEMPLARY EMBODIMENTS

The exemplary embodiments of the present disclosure may be further understood with reference to the following description and the related appended drawings. The exemplary embodiments of the present disclosure relate to storage system to facilitate expedited and/or emergency evacuation procedures. The exemplary embodiments are described with reference to the storage system for a portable transportation article, arrangement or unit, such as an emergency sheet stretcher, although those having ordinary skill in the art will understand that the exemplary embodiments of the present disclosure may be implemented to store other medically-related devices and portable transportation units.

FIG. 1 shows an exemplary embodiment of an exemplary storage arrangement 110 having a front panel 112, two side panels 118, 120, a top panel 116, and a bottom panel 114. In the exemplary storage arrangement 110 shown in FIG. 1, as well as in FIGS. 1-8, the arrangement 110 does not include a back panel. Instead, the exemplary storage arrangement 110 can be mounted on a support unit/arrangement, such as a wall, device, or a hospital bed, and the support unit/arrangement can act as a back panel for the exemplary storage arrangement 110. In other exemplary configurations, the exemplary storage arrangement 110 can include a back panel that can have generally the same dimension as the front panel 112 to house the portable transportation unit/arrangement 122.

The exemplary storage arrangement 110 can be dimensioned and/or configured to house and/or enclose the portable transportation unit/arrangement 122, such as an emergency evacuation sheet. In one exemplary embodiment, the width 124 of the exemplary storage arrangement 110 can be approximately at least 10 inches and approximately at most 20 inches. The height 126 of the exemplary storage arrangement 110 can be approximately at least 7 inches and approximately at most 17 inches. The depth 128 of the exemplary storage arrangement 110 can be approximately at least 1 inches and approximately at most 10 inches. In the exemplary storage arrangement shown, the width 124 can be approximately 15 inches, the height 126 can be approximately 12 inches, and the depth 128 can be approximately 2.5 inches. It should be understood that other suitable dimensions can also be used.

The exemplary storage arrangement 110 can be composed (e.g., in part or wholly) of a clear or lucite material, such as plastic or acrylic, so that the material does not interfere with nearby electronic devices and the portable transportation unit/arrangement 122 is easily visible through the exemplary storage arrangement 110. In other exemplary configurations, the exemplary storage arrangement 110 can be composed (e.g., in part or wholly) from an opaque material, rather than clear. In yet other exemplary configurations, the exemplary storage arrangement 110 can be composed (e.g., in part or wholly) from an opaque material except for certain panels, such as the front panel 112, to facilitate partial viewing of the portable transportation unit/arrangement 122. The exemplary storage arrangement 110 can also be composed (e.g., in part or wholly) of any other suitable material.

Figure 2:
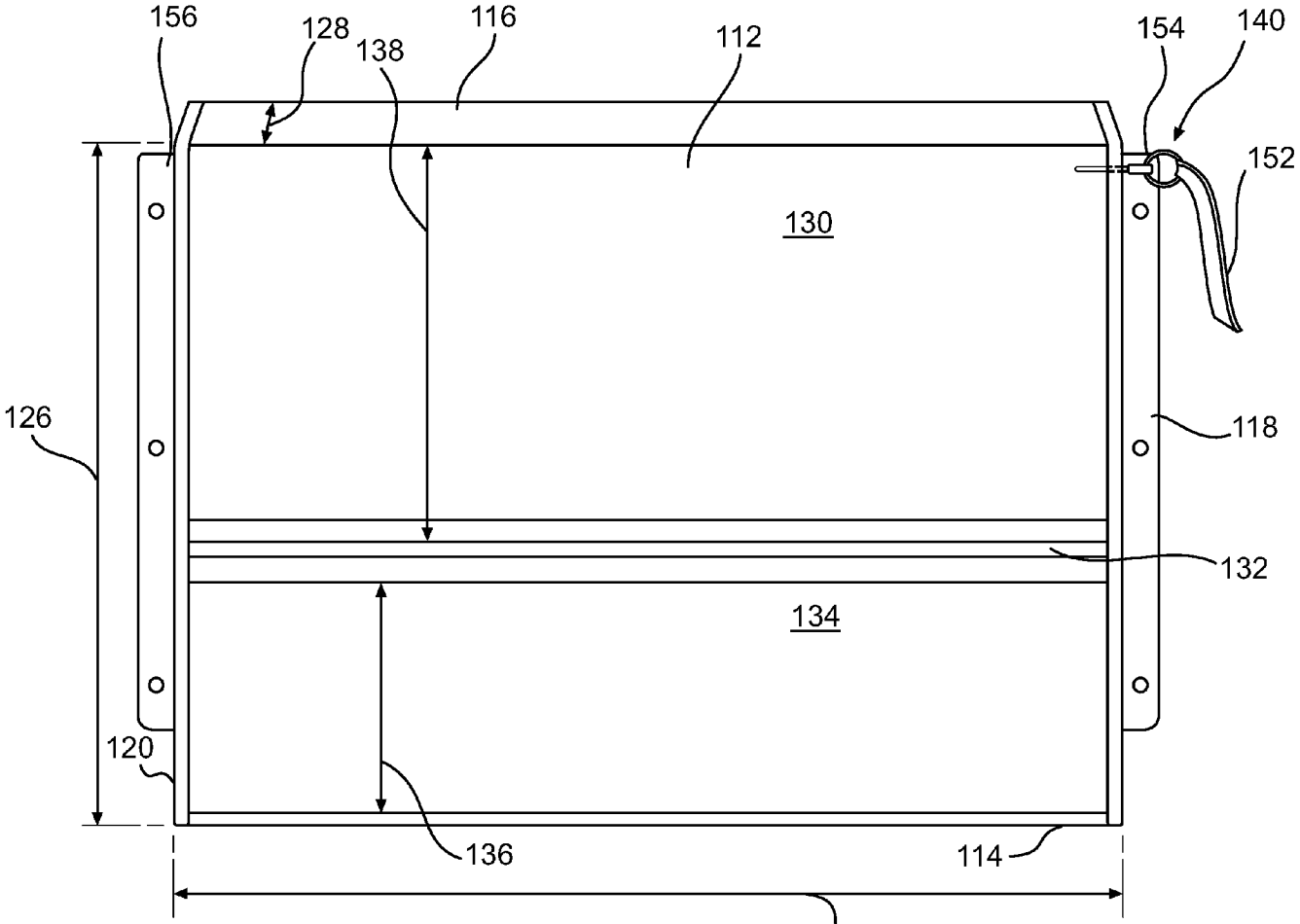
FIG. 2 is an illustration of the exemplary storage arrangement of FIG. 1 without an article inserted therein.
Figure 3:
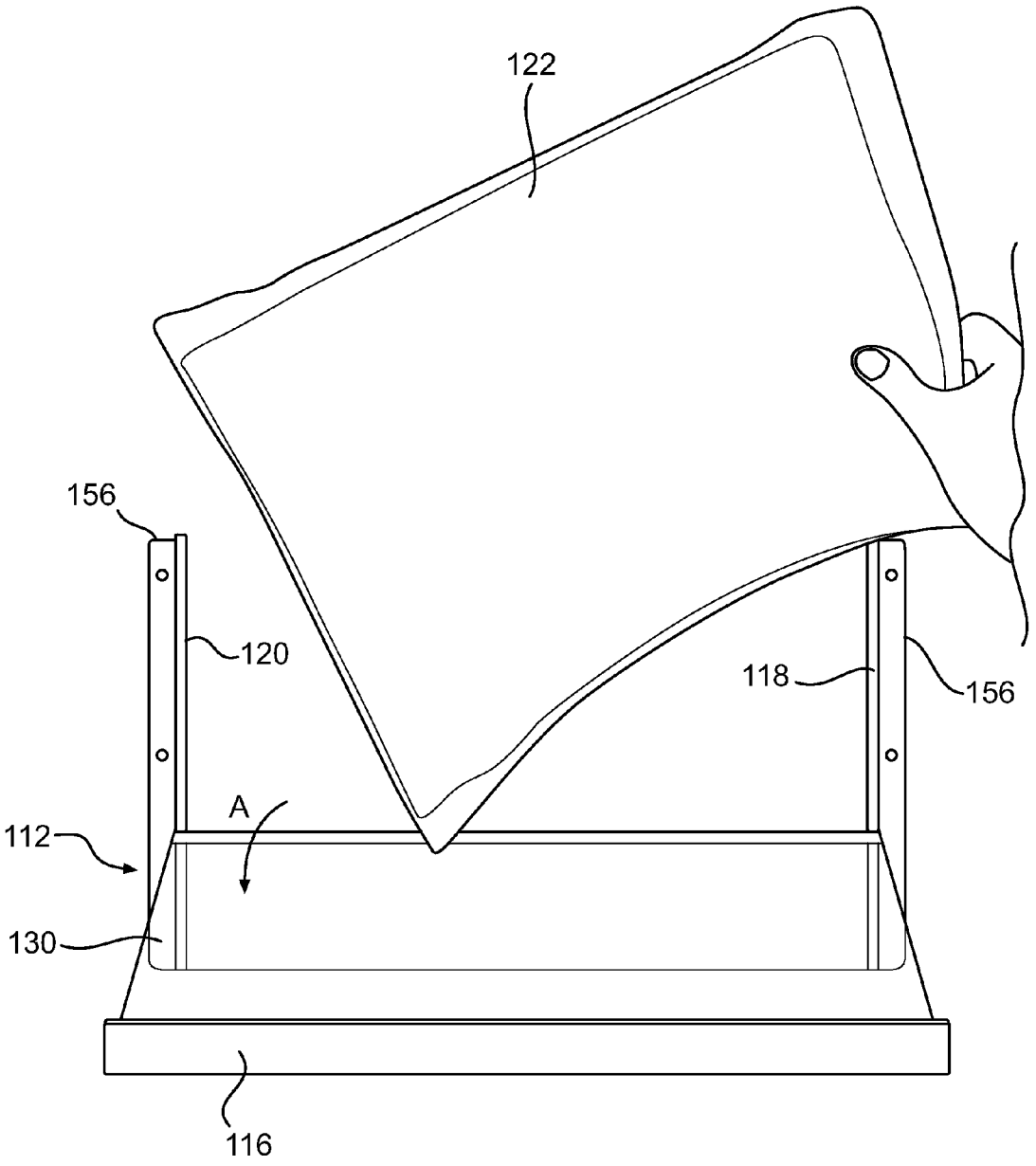
FIG. 3 is an illustration of the exemplary storage arrangement of FIG. 1 in an open configuration.

The exemplary storage arrangement 110 can be configured such that the front panel 112 can be moved from a closed position, as shown in FIG. 1, to an open configuration, as shown in FIG. 3. FIG. 2 shows the exemplary storage arrangement 110 of FIG. 1 without the unit/arrangement 122 inserted therein. In a closed configuration, the exemplary storage arrangement 110 can securely hold a portable transportation unit/arrangement 122. In the open configuration, the exemplary storage arrangement 110 can facilitate easy removal and/or insertion of the portable transportation unit/arrangement 122.

Figure 4:
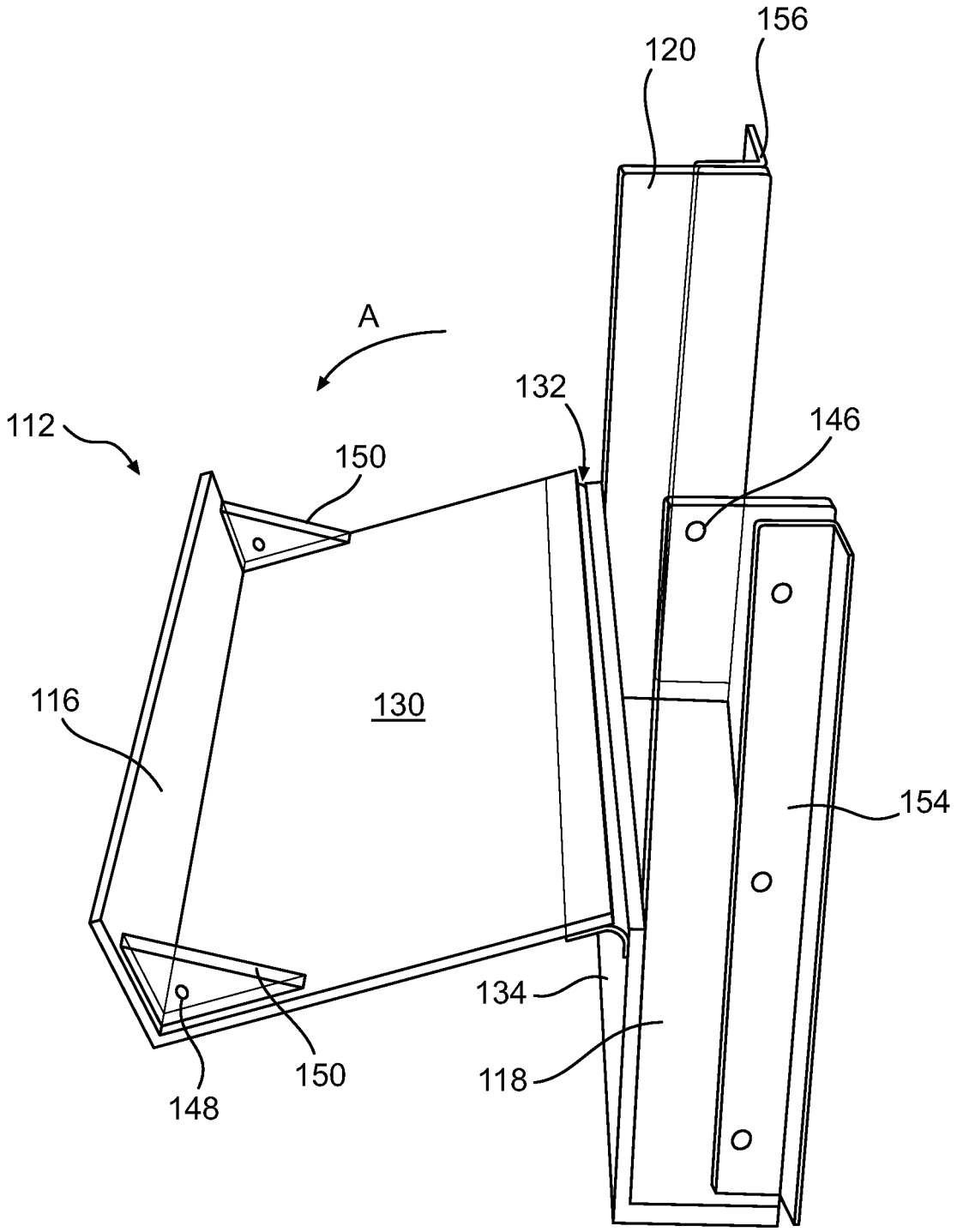
FIG. 4 is a side view of the exemplary storage arrangement of FIG. 1 in an open configuration.

For example, the exemplary front panel 112 of the exemplary storage arrangement 110 can include a door portion 130 and a panel portion 134. The exemplary panel portion 134 can be affixed or attached to the bottom panel 114, and can remain fixed as the door portion 130 is moved from a closed to an open position, and vice versa. To move the door portion 130 from a closed position to an open position, the door portion 130 can be pulled downward in a direction "A", as shown in FIGS. 3 and 4.

The door portion 130 can be attached to the panel portion 134 at a hinge 132. The exemplary hinge 132 can be a piano hinge made of plastic, such as polyvinyl chloride. In other exemplary configurations, the exemplary hinge 132 can be a living hinge, a butt hinge, a butterfly hinge, a flushing hinge, or another suitable hinge configuration. The exemplary hinge 132 can also be made of other suitable material, such as, e.g., metal or other types of plastic.

The exemplary door portion 130 and the panel portion 134 can be dimensioned and/or configured such that in the open configuration, the portable transportation unit/arrangement 122 can be easily inserted or removed from the exemplary storage arrangement 110. In one exemplary embodiment, the exemplary door portion 130 and the panel portion 134 can be generally the same height 136,138. In other exemplary embodiment, the exemplary door portion 130 and the panel portion 134 can have different suitable dimensions. For example, the exemplary door portion 130 can have a height 138 that is greater than the height 136 of the panel portion 134. The exemplary hinge 132 can be positioned near or at the center of the front panel 112. For example, in the exemplary storage arrangement 110 shown, the hinge 132 can be approximately 5.25 inches from the bottom of the front panel 110.

The exemplary door portion 130 can also include the top panel 116 such that, when the exemplary door portion 130 is moved into an open configuration, as shown in FIG. 3, the top panel 116 can also be moved to facilitate the insertion and/or the removal of the portable transportation unit/arrangement 112. In the exemplary storage arrangement 110, the door portion 130 and the top panel 116 can be composed (e.g., in part or wholly) from unitary construction, or in other configurations, can be composed (e.g., in part or wholly) from separate construction. The exemplary door portion 130 and the top panel 116 can also form a right angle, although in other exemplary configurations, can form other suitable angles. The exemplary storage arrangement 110 can further include support brackets 150 that can be affixed between the door portion 130 and top panel 116. The exemplary support bracket 150 can be disposed slightly inward from the sides of the door portion 130 and top panel 116 such that when in the closed configuration, the support bracket 150 can be positioned inward with respect to the side panels 116, 118.

In a further exemplary embodiment of the exemplary storage arrangement 110, the exemplary hinge 132 can be configured to create and/or provide a tight seal between the door portion 130 and the panel portion 134, and thus, prevent the portable transportation unit/arrangement 122 inside the storage arrangement 110 from being soiled or broken. The exemplary door portion 130 can further include seals around the edges of the door and top panel 116 to keep the portable transportation unit/arrangement 122 in a clean and un-tampered state.

Figure 5:
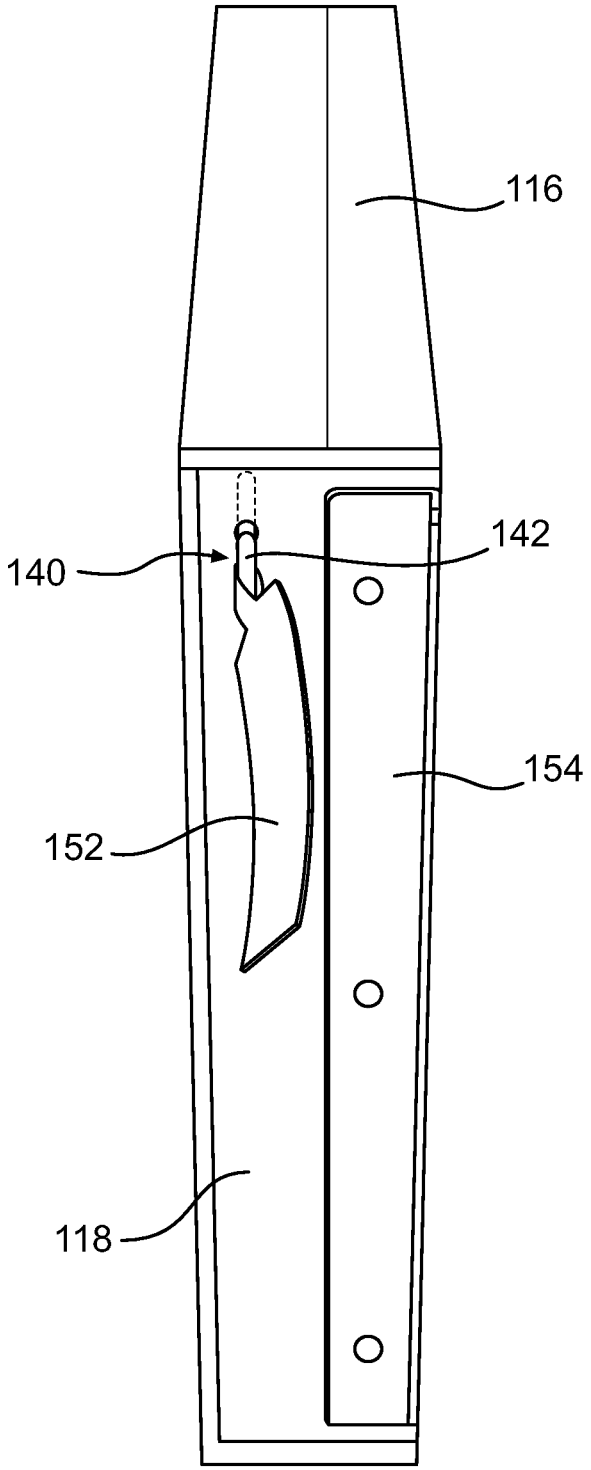
FIG. 5 is a side view of the exemplary storage arrangement of FIG. 1 in a closed configuration.
Figure 6:
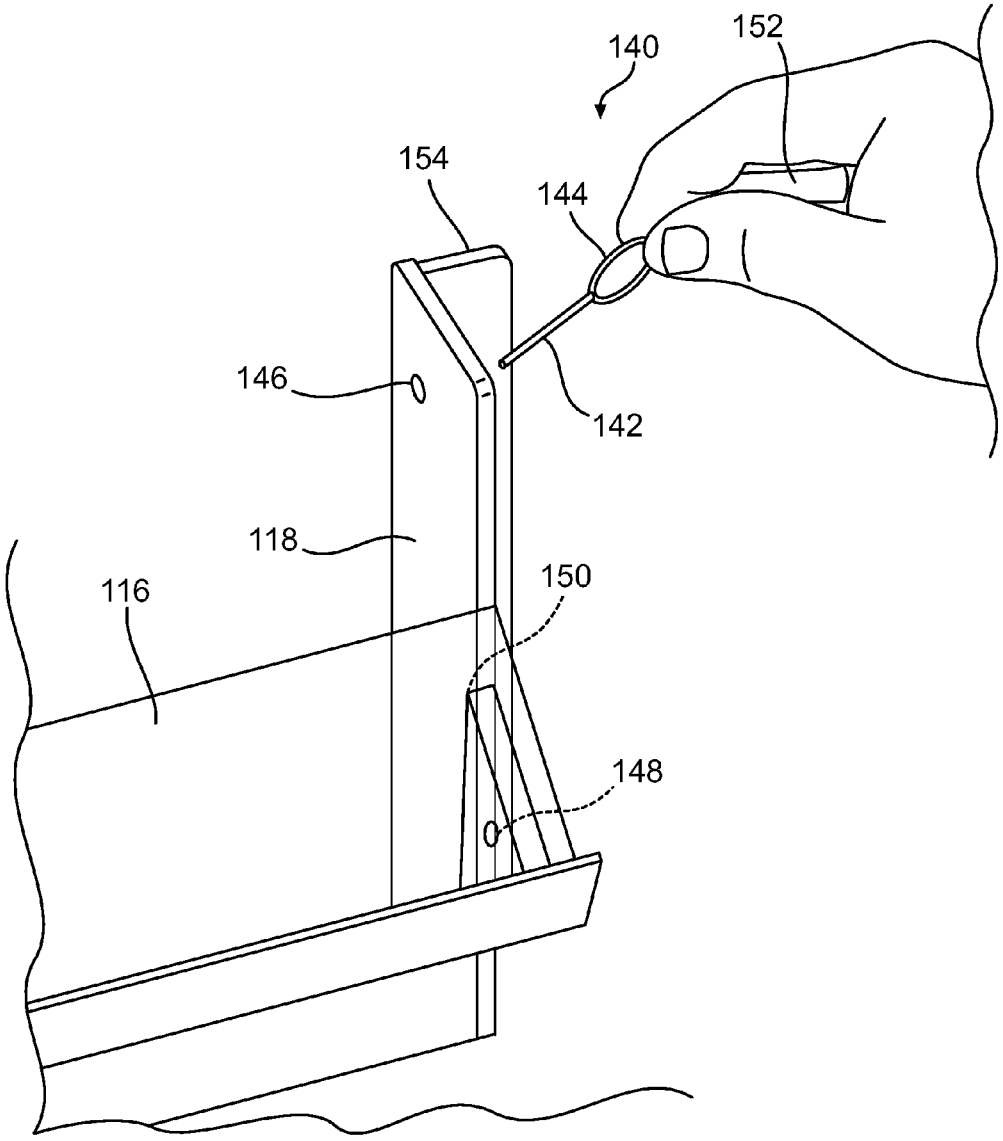
FIG. 6 is an illustration of the exemplary locking mechanism of the exemplary storage arrangement of FIG. 1.

The exemplary storage arrangement 110 can also include a locking mechanism 140. The exemplary locking mechanism 140 can be provided on one side panel 118 or 120, or both side panels 118, 120. The exemplary locking mechanism 140 can be, e.g., a pin-lock mechanism, as shown in FIGS. 1-8. The exemplary pin-lock mechanism can include a pin 142 and pin holes 146, 148 configured to receive the pin 142. The exemplary pin 142 can be configured such that it is easily removable by a user, particularly in times of an emergency, but secure enough so that the pin 142 would not fall from the exemplary storage arrangement 110 by itself. In the exemplary pin-lock mechanism, a first pin hole 146 can be on at least one side panel 118, and a second pin hole 148 can be on at least one support bracket 150 on the same side as the first pin hole 146. When the exemplary storage arrangement 110 is provided in the closed configuration, as shown in FIG. 5, the first and second pin holes 146, 148 can be superimposed and aligned with respect to each other such that the pin 142 can be and/or remain inserted through both the first and second pin holes 146, 148 to lock and secure the exemplary storage arrangement 110.

Figure 7:
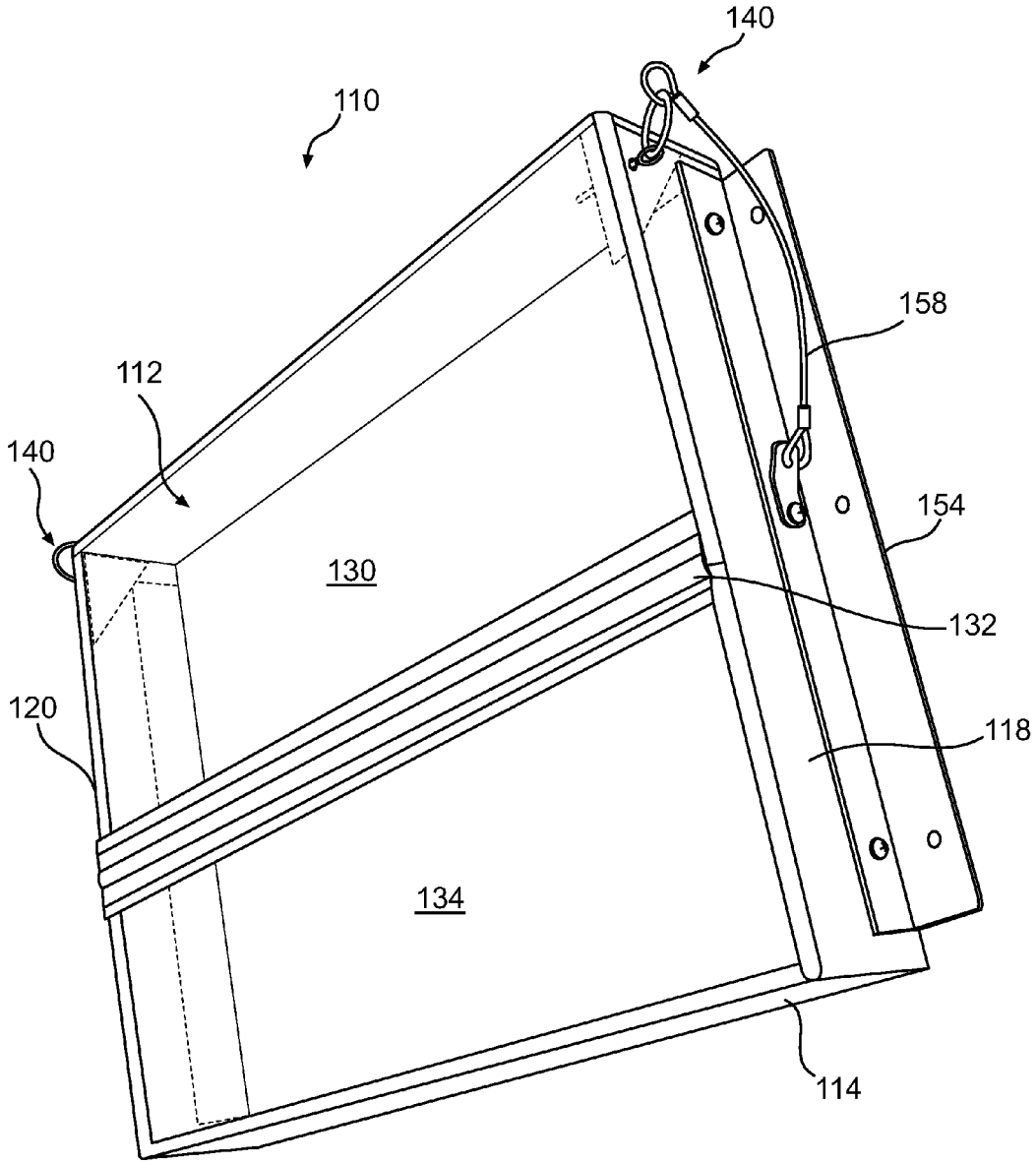
FIG. 7 is an illustration of the exemplary locking mechanism of the exemplary storage arrangement according to another exemplary embodiment of the present disclosure.
Figure 8:
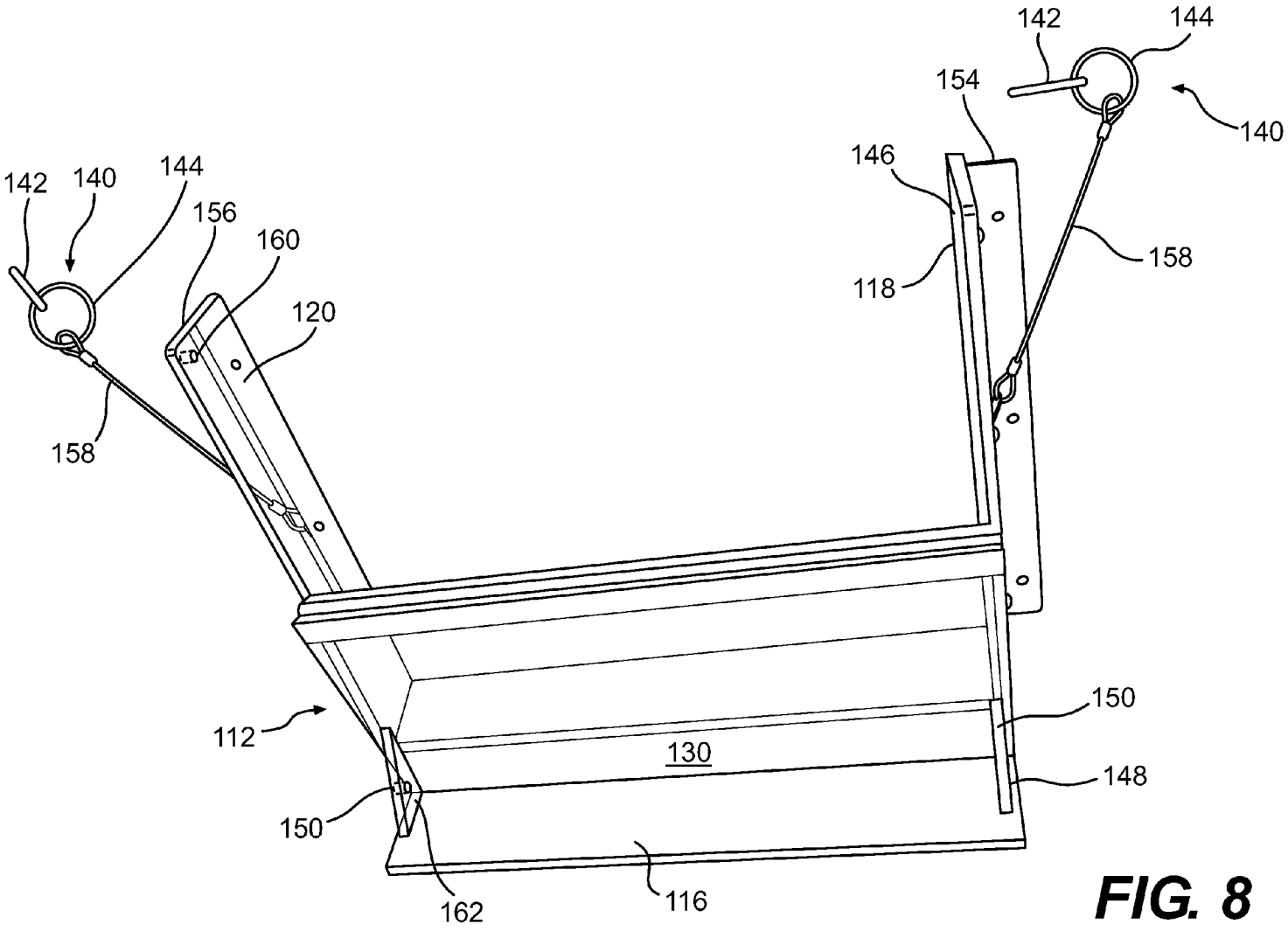
FIG. 8 is the exemplary storage arrangement of FIG. 7 in the open configuration.

The exemplary pin 142 can further include a handle portion 144. The handle portion 144 can facilitate a user to easily grab and/or hold the pin 142, and also acts as a stop mechanism to prevent the pin 142 from going all the way through the pin holes 146, 148. The pin 142 can also include a lanyard 152 (as shown in FIG. 1) to facilitate securing the pin 142 to a bed, person, wall, or other location so as to reduce the likelihood of pin 142 from being lost. In other exemplary configurations, a connecting member 158, such as a plastic string or plastic coated cable, can be used to connect the exemplary pin 142 to the respective side panel 118 or 120 (as shown in FIGS. 7 and 8). The length and/or configuration of the connecting member 158 can be sufficient enough to facilitate the exemplary pin 142 to be removed and inserted into the pin holes 146, 148. Other suitable locking mechanisms can also be used, such as a key, bracket, or other similar types of locks. More than one exemplary locking mechanisms can be used (i.e. more than one pin), and/or more than one type of locking mechanism used.

For example, in one exemplary embodiment of the exemplary locking mechanism 140, the exemplary storage arrangement 110 can include two exemplary locking mechanisms 140 on both side panels 118, 120. In one such exemplary configuration, as shown in FIGS. 7 and 8, the exemplary pin-lock mechanism (as described above) can be used on both side panels 118, 120. For example, similarly to the exemplary pin-lock mechanism described above, a second panel 120 can include a pin hole 160 and the respective support bracket 150 on the front panel 112 can also include a pin hole 162. When provided in the closed configuration, pin holes 160, 162 can be superimposed and aligned such that the exemplary pin 140 can go through. The exemplary pin 142 can be affixed to a connecting member 158, such as a plastic coated cable, which is further affixed to the side panels 118, 120, respectively.

In one exemplary configuration of the exemplary storage arrangement 110, the exemplary storage arrangement 110 can include an indicator mechanism that can indicate to the user that the exemplary storage arrangement 110 had been previously opened. For example, the exemplary locking mechanism 140 can include a breakable seal, such that when the exemplary pin 142 is pulled from the pin holes 146, 148, the seal is broken which indicates to the user that the exemplary storage arrangement 110 has been opened. The seal can be replaceable, such that when a new portable transportation unit/arrangement 122 is inserted into the exemplary storage arrangement 110, a new seal can be placed on the exemplary pin-lock mechanism. Other suitable indicator means can also be used.

In other exemplary configurations of the exemplary storage arrangement 110, the exemplary locking mechanism 140 can form a tight seal, and a tight seal can be further formed around the top panel 116 and door portion 130 to prevent the portable transportation unit 112 from being spoiled or broken.

The exemplary storage arrangement 110 can further include securing brackets 154, 156 that can be configured to secure the exemplary storage arrangement 110 to a unit, such as a wall, hospital bed, or other location. The exemplary securing bracket 154, 156 can be composed (e.g., in part or wholly) of metal, plastic, or other suitable materials. The exemplary securing brackets 154, 156 can be right-angle brackets, where on side of one of the securing bracket 154, 156 is affixed to one of the side panel 118, 120, respectively. Each of the exemplary securing brackets 154, 156 can be affixed to one of the side panels 118, 120, respectively, by screws, rivets, pins, glue, or other similar method. Each of the exemplary securing brackets 154, 156 can be further affixed to a unit, such as a wall, hospital bed, or other suitable location by screws, nails, rivets, pins, or other similar method. Other suitable brackets 150 can also be used.

During operation and/or use of the exemplary storage arrangement, a user can disengage the exemplary locking mechanism 140, for example, by pulling and releasing the exemplary pin 142 from the pin holes 146, 148. The user can then pull at the first and top panel 112, 116 in a generally downward angle direction (direction "A" as shown in FIGS. 3 and 4). The user further can remove and/or insert a portable transportation unit/arrangement 122. To close the exemplary storage arrangement 110, the user can move the door portion 130 in a generally upward direction, and re-engage the locking mechanism 140, for example, by placing the exemplary pin 142 back through the pin holes 146, 148. It should be appreciated that there can be one or more locking mechanisms used (e.g., more than one pin), and/or more than one type of locking mechanism used.

Figure 9:
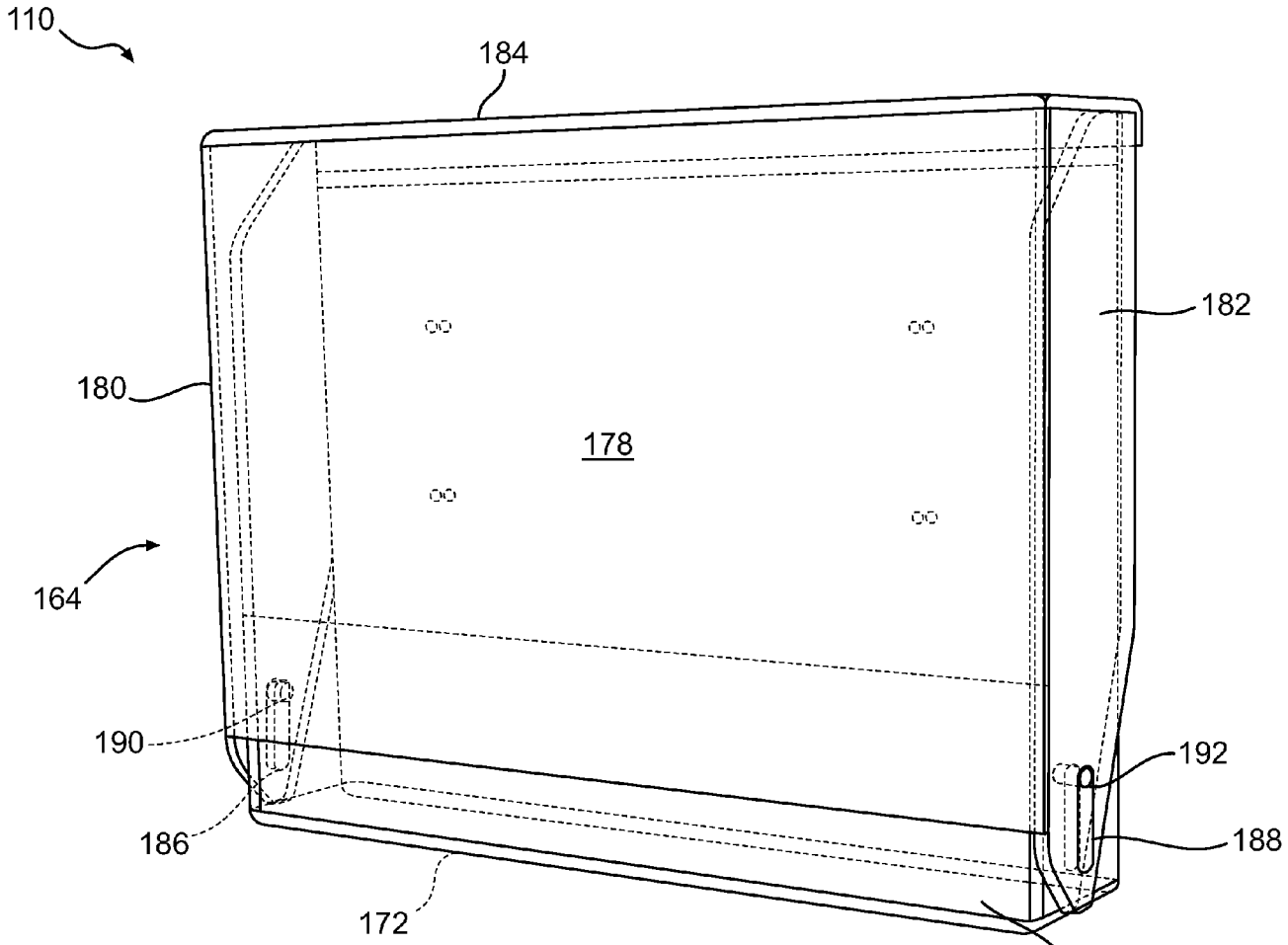
FIG. 9 is an illustration of another exemplary storage arrangement according to a further exemplary embodiment of the present disclosure in an exemplary closed configuration.
Figure 10:
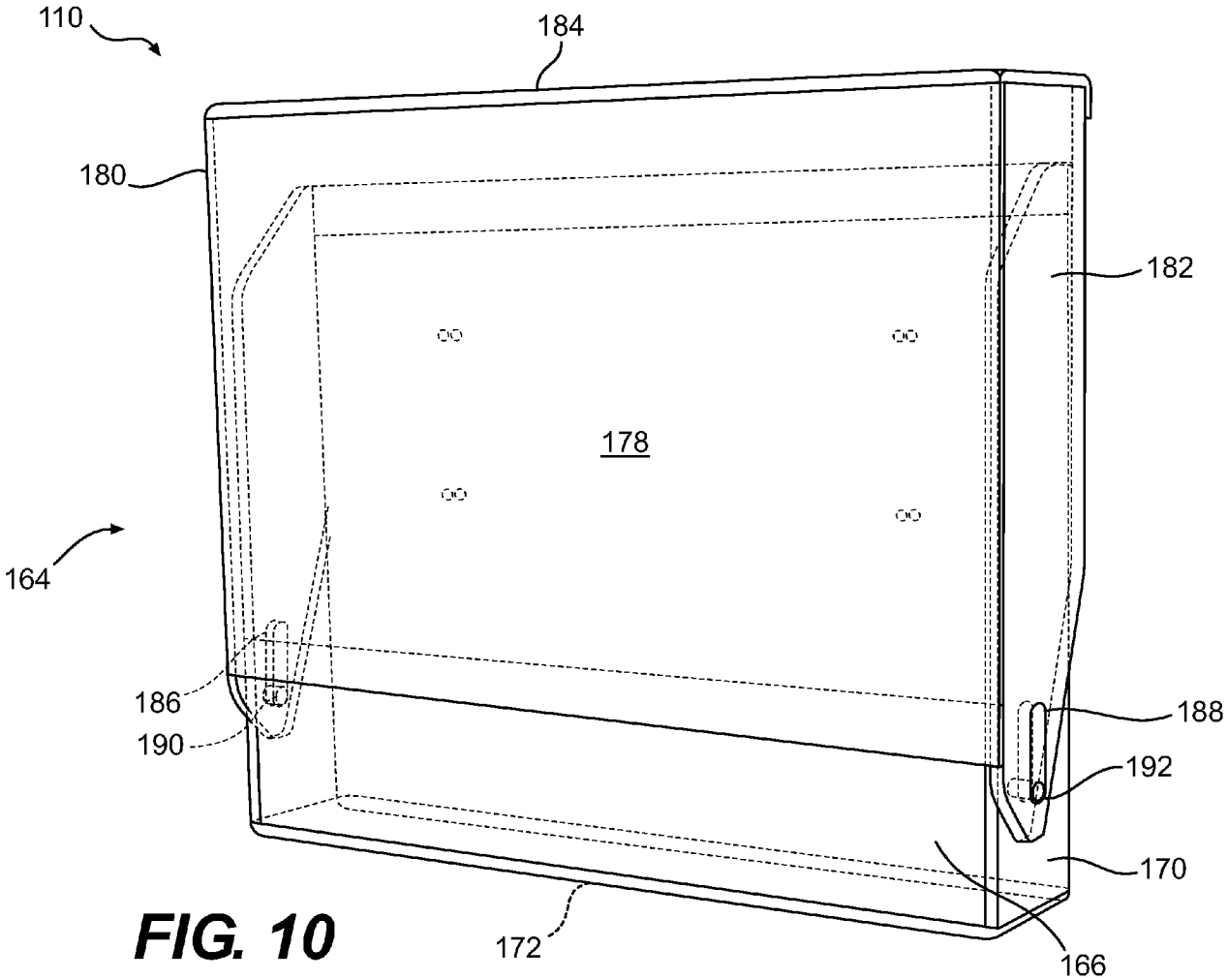
FIG. 10 is the exemplary storage arrangement of FIG. 9.
Figure 11:
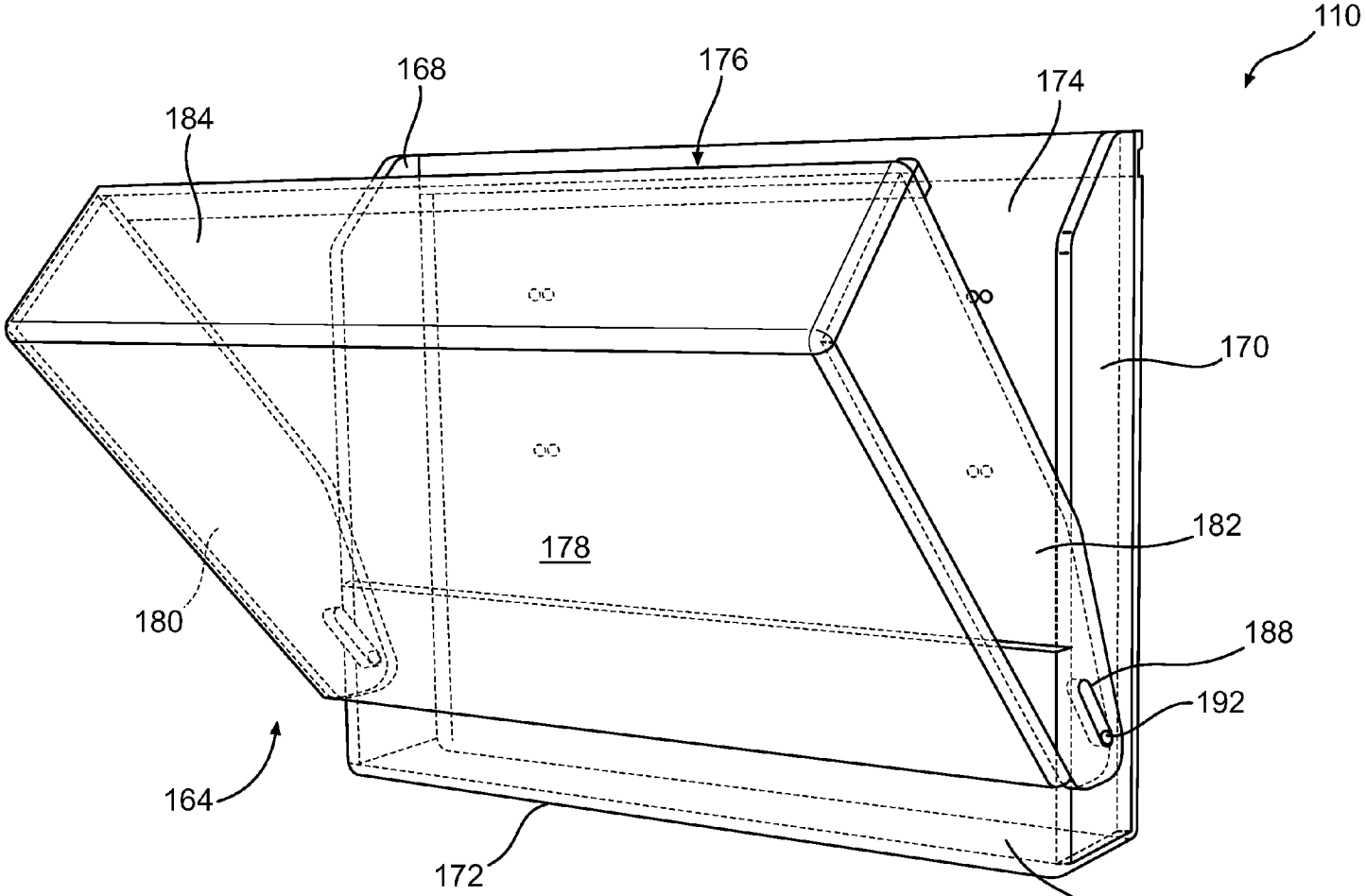
FIG. 11 is the exemplary storage arrangement of FIG. 9 in an open configuration.

According to further exemplary configurations of the exemplary storage arrangement 110 of the present disclosure, as shown in FIGS. 9-15, the exemplary storage arrangement 110 can include an access door 164. The access door 164 can be configured for moving from a closed position, as shown in FIG. 9, to an exemplary open configuration, as shown in FIG. 11. In an exemplary closed configuration, the exemplary storage arrangement 110 can securely hold a portable transportation unit/arrangement 122. In the exemplary open configuration, the exemplary storage arrangement 110 can facilitate an easy removal and/or insertion of the portable transportation unit/arrangement 122.

In such exemplary configuration(s), the exemplary storage arrangement 110 can further include two or more side panels 168, 170, a bottom panel 172, a holding panel 166, and in some configurations, a back panel 174. As discussed above, it should be appreciated that in some configurations, the exemplary storage arrangement 110 may not include a back panel 194. The holding panel 166 can be disposed adjacent the two side panels 168, 170, and the holding panel 166, two side panels 168, 170, and back panel 174, in some configurations, can together define an open area 176 for receiving the portable transportation unit/arrangement 112. The exemplary holding panel 166 can facilitate holding the portable transportation unit/arrangement 112 within the open area 176. The holding panel 166 can have a height that is less than the back panel 174 to define an open area 176 that facilitates easy insertion and removal of the portable transportation unit/arrangement 112. In other exemplary configurations, the holding panel 166 can have other suitable dimensions.

Referring back to FIGS. 9-11, the access door 164 can have front portion 178, two or more side portions 180, 182 and a top panel 184. In the exemplary storage arrangement 112, the access door 164 can be positioned such that the front portion 178 is adjacent the open area 176 and holding panel 164, and the two side portions 180, 182 of the access door 164 are adjacent the two side panels 168, 170, respectively. The top panel 184 can be configured such that when the exemplary access door 164 is moved into an open configuration, as shown in FIG. 11, the top panel 184 can also be moved to facilitate the insertion and/or the removal of the portable transportation unit/arrangement 112. In one exemplary configuration of the exemplary storage arrangement 110, the access door 164 and the top panel 184 can be composed (e.g., in part or wholly) from unitary construction, or in other configurations, can be composed (e.g., in part or wholly) from separate construction. The exemplary access door 164 and the top panel 184 can also form, e.g., a right angle, although in other exemplary configurations, can form other suitable angles.

Figure 12:
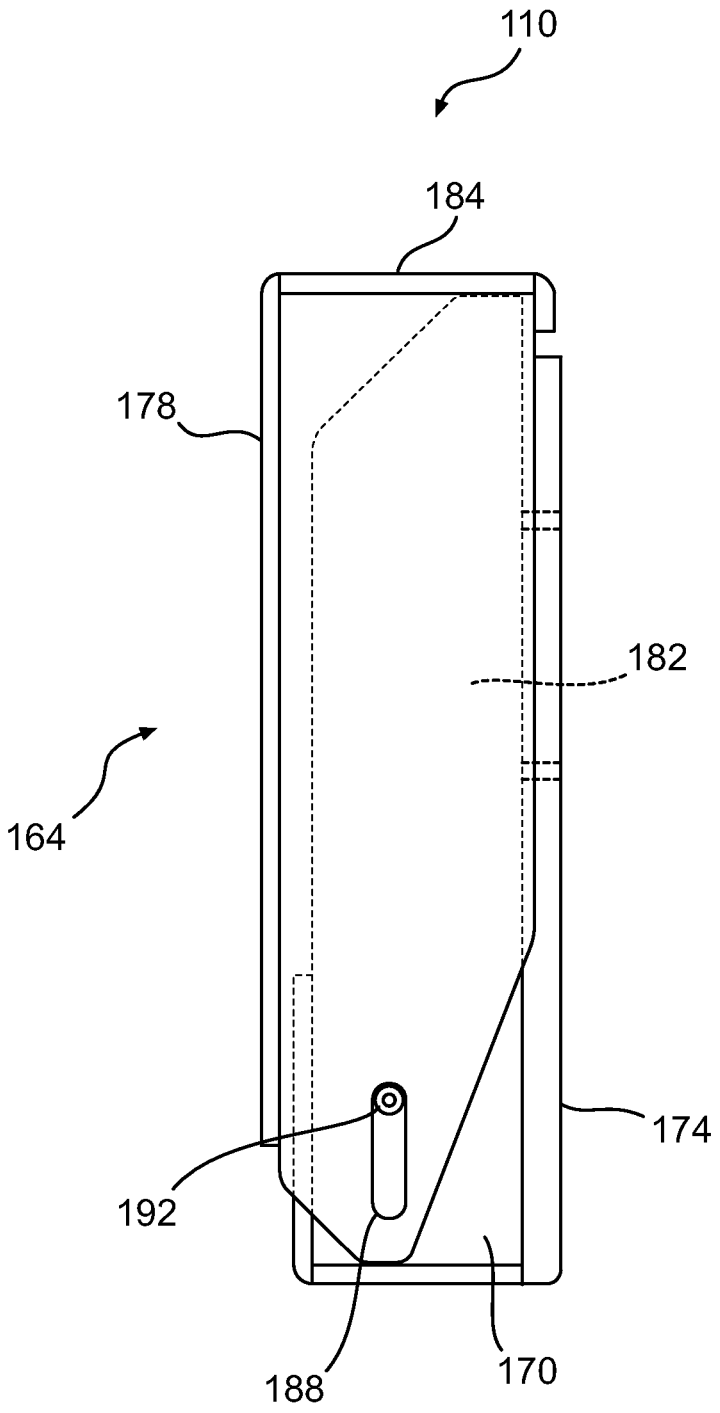
FIG. 12 is the side view of the exemplary storage arrangement of FIG. 9.
Figure 13:
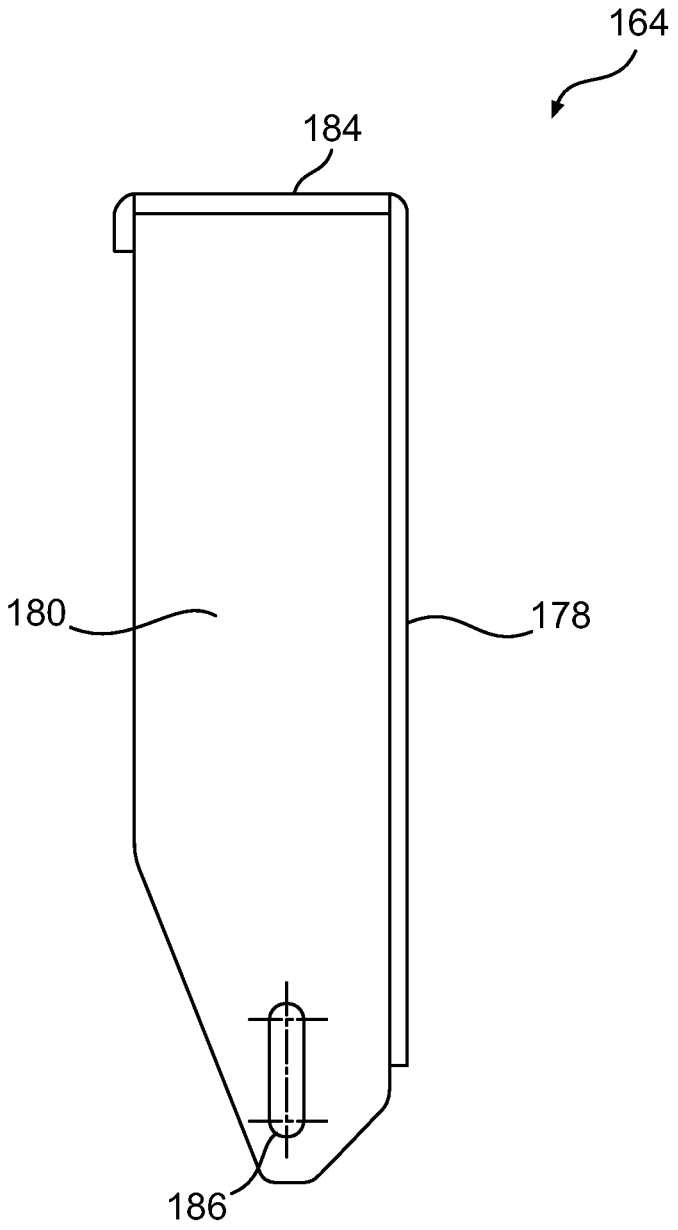
FIG. 13 is the side view of the exemplary access door of the exemplary storage arrangement of FIG. 9.
Figure 14:
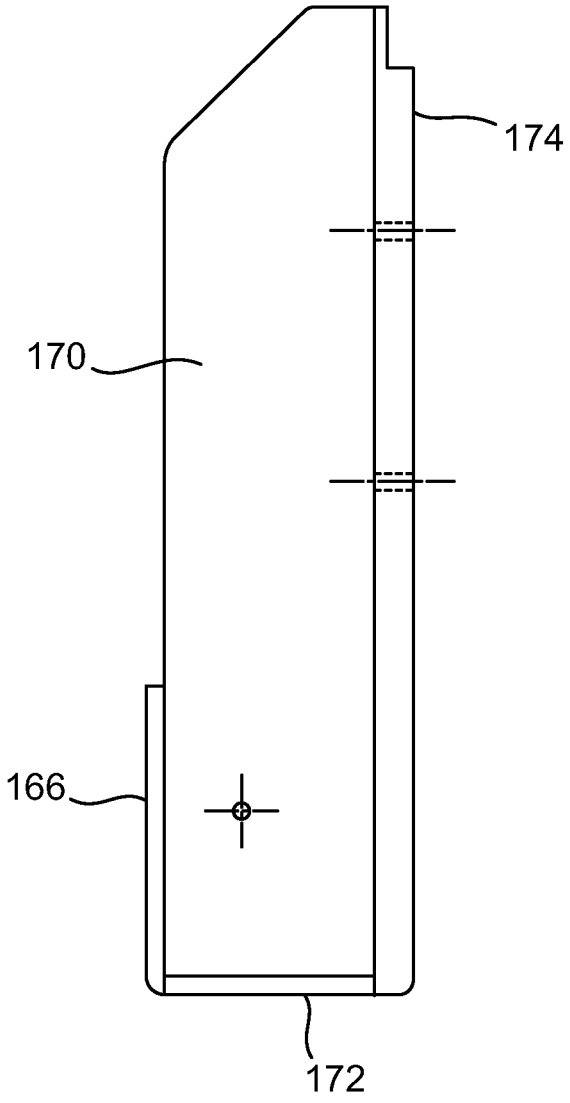
FIG. 14 is the side view of the exemplary storage arrangement of FIG. 9 without the exemplary access door.

The access door 164 can further include at least two slots 186,188 that can extend vertically along the side portions 180,182, respectively, for example as shown in FIG. 12. The exemplary storage arrangement 110 can further include protrusions 190, 192, which can protrude or extend from the side panels 168, 170. In the exemplary storage arrangement 110, each side panels 168, 170 can comprise at least one protrusion 190, 192. In the exemplary storage arrangement 110, the exemplary protrusions 190, 192 can be fixed onto the side panels 168, 170. The exemplary protrusions 190, 192 are dimensioned and configured to fit within or mate with the slots 186,188 such that the access door 164 can have vertical movement upward and downward with respect to the protrusions 190, 192. The movement of the access door 164 can be limited by the placement of the protrusions 190, 192. The protrusions 190, 192 can also be configured to allow other movement, such as pivoting movement, of the access door 164. One example of such other movement is described further below.

Referring to FIGS. 9-11, during operation and/or use of the exemplary storage arrangement 110 shown therein, a user can open the exemplary storage arrangement 110, for example, by moving the access door 164 upward. As the access door 164 is moved upward, the slots 186,188 of the door 166 can slide with respect to the protrusions 190, 192. As discussed above, the movement of the door 166, in some exemplary configurations, can be limited by the position of the protrusions 190, 192. For example, the movement of the access door 164 can have an upward limit and/or an outward limit, as shown in FIG. 10, and a downward limit, as shown in FIG. 11, which can depend on the positions of the protrusions 190, 192. For example, at the upward limit position, the protrusion 190, 192 can be positioned at a bottom-most portion of the slot 186, 188, and in the downward limit position, the protrusions 190, 192 can be positioned at a top-most portion of the slot 186, 188. In other configurations, the movement of the access door 164 can be limited by other suitable structures or arrangements.

When the movement of the exemplary storage arrangement 110 is at an upward limit, for example as shown in FIG. 10, the exemplary access door 164 can be moved about, for example pivoted about, the protrusions 190, 192 such that the access door 164 can be tilted outward and/or away from the open area 176 to allow the portable transportation unit/arrangement 112 to be removed. For example, at the exemplary upward limit, the user can tilt or move the access door 164 forward, outward, and/or away from the open area 176, as shown in FIG. 11. The user can then access the open area 176 to either remove or insert the portable transportation unit/arrangement 112. To close the exemplary storage arrangement 166, a user can align the side portions 180, 182 of the access door 164 with the side panels 168, 170 by moving the access door 164 toward the open area 176. The user can then slide or move the access door 164 in a downward direction. In the closed position, the open area 176 can be covered by the access door 164 and holding panel 166.

FIGS. 12-15 illustrate other exemplary views of the exemplary storage arrangement shown in FIG. 9. It should be noted that the exemplary storage arrangement 110 shown in FIGS. 9-15 can include the exemplary features described in FIGS. 1-8. For example, the exemplary storage arrangement 110 shown in FIGS. 9-15 can include the exemplary locking mechanisms and/or securing brackets described herein.

Figure 15:
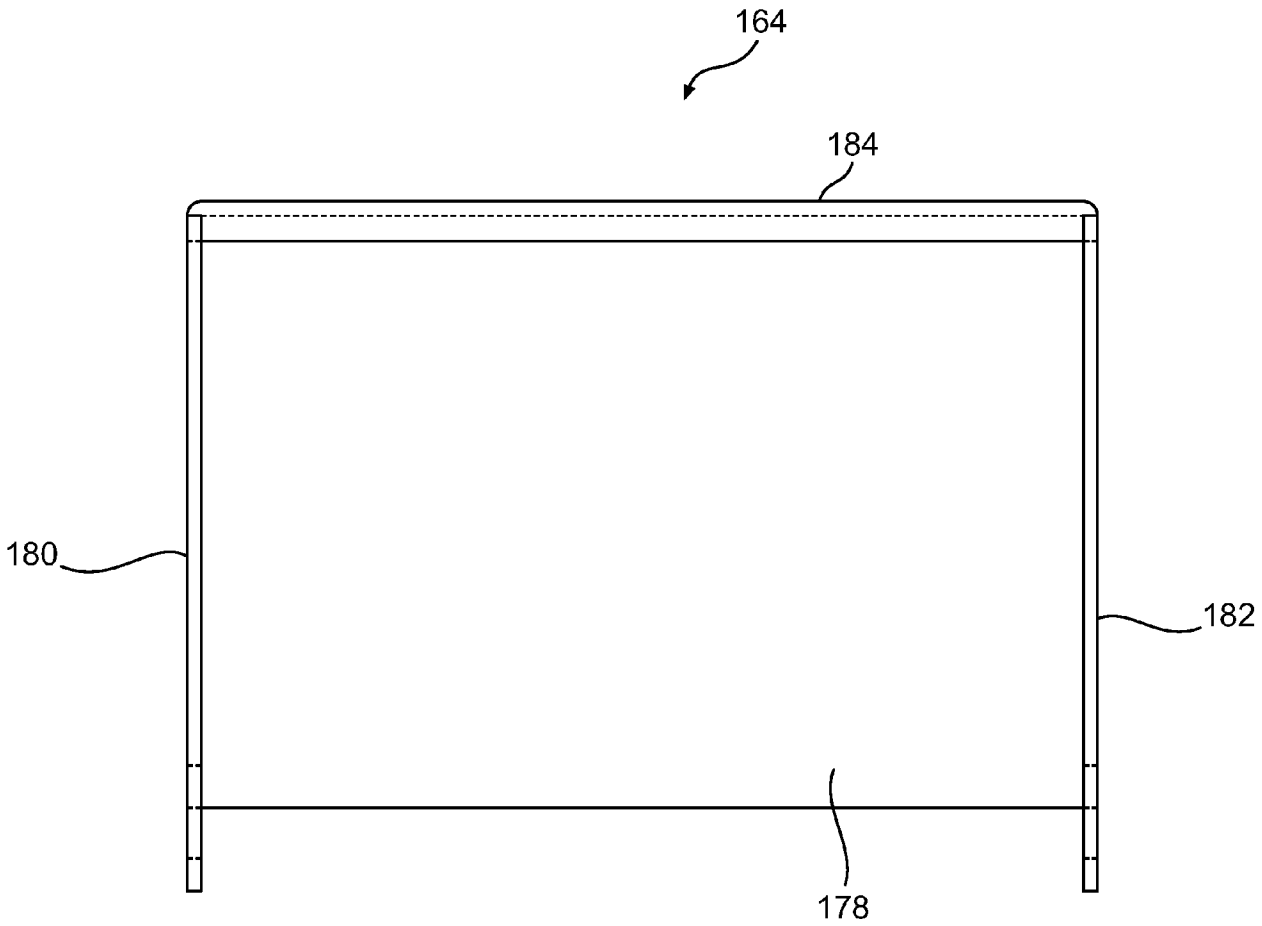
FIG. 15 is the front view of the exemplary access door of the exemplary storage arrangement of FIG. 9.

The exemplary storage arrangement 110 according to various exemplary embodiments described herein can have rounded corners, straight corners, or other suitable configurations. For example, as shown in FIG. 15, the access door 164 and/or side panels 168, 170 can have rounded corners. The exemplary panels and portions of the exemplary storage arrangement 110 can be affixed together to form the exemplary storage arrangement 110 as described herein by bonding, welding, or other suitable methods.

While the exemplary storage arrangement 110 according to various exemplary embodiments described herein can be configured to hold portable transportation units 122, it should be appreciated that in other exemplary configurations, the exemplary storage arrangement 110 can be configured to hold other medically-related devices, drugs, etc.

The foregoing merely illustrates the principles of the exemplary embodiments of the present disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances. Further, to the extent that the prior art knowledge has not been explicitly incorporated by reference herein above, it is explicitly incorporated herein in its entirety. All publications referenced are incorporated herein by reference in their entireties.

Various components of the exemplary storage arrangement can include any number of dimensions, and FIGS. 1-16 illustrate exemplary sets of dimensions for certain exemplary embodiments of the present disclosure. Other dimensions, e.g. for other exemplary embodiments, are also possible.

Any and all references specifically identified in the specification of the present application are expressly incorporated herein in their entirety by reference thereto. The term "about" and "approximately" as used herein, should generally be understood to refer to both the corresponding number and a range of numbers. Moreover, all numerical ranges herein should be understood to include each whole integer within the range.

What is claimed is:

1. A storage arrangement, comprising:

a first section that is moveable between a first configuration and a second configuration, the first section having at least one slot;

a second section coupled to the first section, and comprising at least one protrusion configured and dimensioned to cooperate with the at least one slot to facilitate a movement of the first section with respect to the second section, and a locking mechanism including a removable pin and a pin hole provided on each of the first section and the second section and configured to receive the pin when the first section is in the first configuration, the removable pin including (i) a straight portion configured to be inserted into the first section and the second section, and to secure at least one portion of the first section to the second section, and (ii) a circular portion coupled to the straight portion, wherein a space formed by the first and second sections receives a portable transportation arrangement, and wherein at least one of the first section or the second section is coupled to a configuration provided at or near a patient.

2. The storage arrangement of claim 1, wherein the first section includes at least one side portion, and the at least one slot extends vertically along the at least one side portion.

3. The storage arrangement of claim 2, wherein the second section comprises at least one side panel, and the at least one protrusion extends from the at least one side panel.

4. The storage arrangement of claim 3, wherein the at least one slot is mated with the at least one protrusion, and wherein the first section is pivotable about the at least one protrusion to facilitate a movement of the first section with respect to the second section.

5. The storage arrangement of claim 1, further comprising an indicator that indicates whether the storage arrangement had been previously opened.

6. The storage arrangement of claim 1, further comprising a securing bracket affixed to the second section, and configured to secure the storage arrangement to a wall.

7. The storage arrangement of claim 1, further comprising a securing bracket affixed to the second section, and configured to secure the storage arrangement to a bed.

8. The storage arrangement of claim 1, wherein the circular portion is fixed to the straight portion.

9. A storage arrangement, comprising:

a first section that is moveable between a first configuration and a second configuration, and including at least one slot;

a second section coupled to the first section and including at least one protrusion that is configured and dimensioned to cooperate with the at least one slot for facilitating a movement of the first section with respect to the second section; and a locking mechanism including a removable pin and a pin hole provided on each of the first section and the second section and configured to receive the pin when the first section is in the first configuration, the removable pin including (i) a straight portion configured to be inserted into the first section and the second section, and to secure at least one portion of the first section to the second section, and (ii) a circular portion attached to the straight portion and extending away from the straight portion, wherein a space formed by the first and second sections receives a portable transportation arrangement, and wherein at least one of the first section or the second section is coupled to a configuration provided at or near a patient.

10. The storage arrangement of claim 9, wherein the first section includes a top panel that is affixed to and disposed generally perpendicular to the at least one portion of the first section.

11. The storage arrangement of claim 9, further comprising an indicator that indicates whether the storage arrangement had been previously opened.

12. The storage arrangement of claim 9, further comprising a third section affixed to the first and second sections.

13. The storage arrangement of claim 9, further comprising a fourth panel affixed to the second section, and disposed opposite and parallel to the first section.

14. The storage arrangement of claim 9, further comprising a securing bracket affixed to the second section, and configured to secure the storage arrangement to a wall.

15. The storage arrangement of claim 9, further comprising a securing bracket affixed to the second section, and configured to secure the storage arrangement to a bed.

16. A method of providing a storage arrangement that is configured to be provided near a patient and to receive a portable transportation arrangement, comprising:

providing a first section of the storage arrangement configured to be moved with respect to a second section of the storage arrangement in a first direction, the first section having at least one slot configured to mate with at least one protrusion coupled to the second section to facilitate a movement of the first section with respect to the second section between a first configuration and a second configuration, and providing a locking mechanism including a removable pin and a pin hole provided on each of the first section and the second section and configured to receive the pin when the first section is in the first configuration, the removable pin comprising (i) a straight portion configured to be inserted into the first section and the second section, and to secure at least one portion of the first section to the second section, and (ii) a circular portion attached to the straight portion and extending away from the straight portion, wherein, in operation:

the first section pivots about the at least one protrusion in a second direction which is different from the first direction, and an open area within the second section is formed due to the movement to receive or remove the portable transportation arrangement.

* * * * *